United States Patent [19]

Balland

[11] 4,456,453

[45] Jun. 26, 1984

[54] METHOD OF OXIDIZING AND SIMULTANEOUSLY FIXING SULFUR DYESTUFFS ON CELLULOSIC FIBERS

[75] Inventor: Jean Balland, Chateaurenault, France

[73] Assignee: Manufacture de Produits Chimiques Protex, Paris, France

[21] Appl. No.: 425,075

[22] PCT Filed: Jan. 15, 1982

[86] PCT No.: PCT/FR82/00009

§ 371 Date: Sep. 15, 1982

§ 102(e) Date: Sep. 15, 1982

[87] PCT Pub. No.: WO82/02565

PCT Pub. Date: Aug. 5, 1982

[30] Foreign Application Priority Data

Jan. 19, 1981 [FR] France ..... 81 01183

[51] Int. Cl.[3] ..... D06P 1/30; D06P 3/60

[52] U.S. Cl. ..... 8/554; 8/493; 8/652; 8/918; 8/650

[58] Field of Search ..... 8/650, 554, 652, 493

[56] References Cited

U.S. PATENT DOCUMENTS

| | | | |
|---|---|---|---|
| 3,334,138 | 8/1967 | Feeman | 8/551 |
| 3,702,351 | 11/1972 | Tesson | 525/438 |
| 3,944,382 | 3/1976 | Doerr | 8/650 |
| 4,042,319 | 8/1977 | Baum et al. | 8/650 |

FOREIGN PATENT DOCUMENTS 2703699 8/1978 Fed. Rep. of Germany .

*Primary Examiner*—A. Lionel Clingman
*Attorney, Agent, or Firm*—Karl F. Ross; Herbert Dubno

[57] ABSTRACT

The simultaneous oxidation and fixation are effected in the presence of a stable aqueous composition comprising an oxidation agent selected among the iodates and bromates of alkaline metals and a fixation agent selected among thermo-hardenable cationic resins.

5 Claims, No Drawings

METHOD OF OXIDIZING AND SIMULTANEOUSLY FIXING SULFUR DYESTUFFS ON CELLULOSIC FIBERS

The present invention relates to a process for the simultaneous oxidation and fixing of dyes applied to cellulosic fibers and using sulfur dyestuffs.

Oxidation after the application of a tint with a sulfur dyestuff upon a cellosic fiber can be achieved with a number of compounds. Among the compounds most in use currently, oxygenated water, sodium bichromate, alkali chlorites, potassium iodate, and potassium bromate can be cited.

It is known that for a certain number of sulfur dyestuffs it is necessary to follow the oxidation treatment by another treatment intended to improve the stability and particularly the stability under moist conditions of the dye. Numerous compounds have been proposed for this purpose, for example, compounds with a dicyanodiamide base. In all such cases, however, the use of the different additives is not effective except after oxidation of the respective dyestuff.

Recently it has been proposed to improve upon the earlier processes by carrying out oxidation and fixation of the dye in a common bath, the oxidation being achieved in this case with the aid of sodium chlorite and the fixation obtained with the aid of alkyl derivatives. This process, however, does not provide for the use of one formulation permitting oxidation and fixation starting from a single substance; the separate addition of each of the products under the rigorous conditions of pH and temperature is absolutely necessary because of the instability of the different compounds.

The object of the present invention is to provide for the oxidation and the fixation of sulfur dyestuffs in a common bath, the introduction in the form of a single stable compound of a derivative serving to achieve simultaneously this oxidation and this fixation.

It is equally an object to provide stable aqueous formulations combining the oxidizing agents and the fixation agents serving in the post treatment of sulfur dyestuffs.

Thus the invention relates to a process of oxidation and fixation simultaneously in the dyeing of cellulosic fibers with sulfur dyestuffs, whose novelty resides in that it is effected in the presence of a stable aqueous formulation combining an oxidation agent selected from iodates and bromates of alkali metals and a fixation agent selected from the thermohardenable (thermosetting) cationic resins.

The thermohardenable cationic resin is advantageously selected from the reaction products of a polyester resin having a carboxylic group at the end of a chain, with an epoxyamine addition compound, the reaction being followed by a condensation with epi-chlorohydrin as is described in French Pat. No. 69 16 433 of the applicant.

The polyester resin is obtained by reaction of a saturated or unsaturated aliphatic dicarboxylic acid containing 3 to 10 carbon atoms with a straight or branched chain aliphatic glycol having two primary hydroxylic groups or one primary hydroxylic group and a secondary hydroxylic group, or possible two secondary hydroxylic groups.

The epoxyamine compound is oxygenated by the reaction of a compound whose molecule contains a plurality of epoxy groups, preferably two epoxy groups, with a polyamide containing at least four reactive hydrogen atoms per molecule.

According to another embodiment, the thermohardenable cationic resin is selected from the polyamide polyester copolymers which are soluble in water such as those described in the French Pat. No. 74 40 699 of the applicant; these copolymers are obtained by reacting a saturated or unsaturated aliphatic dicarboxylic acid containing 3 to 10 carbon atoms, with a mixture of polyalkylenic polyamine and dialkanolamine in molar proportions of dicarboxylic acid/polyamine/dialkanolamine of the order of 0.8 to 1.1/0.3 to 0.9/0.1 to 0.7 at a pH between 1 to 3 and at a temperature between 120° to 200° C., the reaction of these copolymers with epichlorohydrin being carried out between 45° and 100° C. in a ratio of 0.5:1.8 mole of epichlorohydrin per active hydrogen atom.

According to another embodiment, the thermohardenable cationic resin is selected from the reaction products of a polyamide derived from a polyalkylenic polyamine and a saturated dibasic aliphatic carboxylic acid containing 3 to 10 carbon atoms with epichlorohydrin alone or conjointly with a quaternization agent such as is described in French Pat. No. 1,265,829.

The relative proportions of the oxidation agent and the thermohardenable cationic resin are between 0.1 and 10% and preferably 2 to 5%.

The quantity of the aqueous formulation which can be used in the process according to the invention, variable as a finding of the application conditions, is between 1 and 30 grams per liter and preferably between 2 and 10 grams per liter.

The process of the invention can be utilized particularly conveniently with application techniques with exhaustion or continuous operation and is applicable to all cellulosic fibers, natural or artificial, alone or mixed with synthetic fibers.

The present invention will be better appreciated with the aid of the following examples which illustrate without limiting it.

EXAMPLE 1

A thermohardenable cationic resin is prepared as described in Example 1 of French Pat. No. 2,041,667 as indicated below:

a—Preparation of Polyester

Into a flask having four necks, equipped for distillation at normal pressure and under agitation, 248 grams (4 moles) of ethylene glycol is introduced.

It is heated to 90° and 100° C. and 702 grams (4.8 moles) of adipic acid is added slowly.

Heating is continued under a nitrogen atmosphere until the temperature of the mixture reaches 200° C. The product is maintained at 200° C. until the acid index falls to 150. One obtains a colorless liquid resin which solidifies at 30° to 40° C.

b—Preparation of epoxyamine addition compound 420 grams (20H amine) of 98% diethylene triamine is introduced into a 4-neck flask. It is heated with agitation to 75° C. Over 30 minutes, 400 grams (2 epoxy equivalents) of epichlorohydrin-bisphenol A with an epoxy index of 0.49 is added with cooling so that the temperature does not exceed 90° C. The reaction mixture is maintained for 30 minutes at 80° to 90° C. before being cooled to 30° C.; at 20° C. it forms a product having a viscosity of 27,400 cps and a Gardner color scale value of 3.

c—Preparation of the cationic resin

An amount of 121 grams (2.68H amine) of the epoxyamine addition compound is heated with agitation to 90° C. after adding over 15 minutes 129 grams (0.28 carboxy equivalents) of polyester prepared as above and previously melted at 80° C.

After the addition, the temperature is maintained at 90° to 100° C. for an additional 30 minutes. 250 grams of water are then added and afterward at 60° to 70° C., 111 grams (1.2 moles) of epichlorohydrin slowly over 30 minutes, while the product is cooled to maintain the temperature at 60° to 70° C. Heating is provided at this temperature until a viscosity of 400 to 600 cps measured at a Haake Rotovisko viscometer (UM=1) is obtained.

480 grams of water is added and the product is heated to 60°-70° C. until the viscosity again reaches 400-600 cps at 20° C.

925 grams of water are added immediately. The product is cooled to 250° C. It is in the form of a liquid solution of 14.8% dry matter having a Gardner color of 3, a viscosity of 20° C. of 43 cps and a pH of 5.3.

A formulation is made by dissolving 10 grams of potassium bromate in 100 grams of the compound obtained.

One obtains a clear solution of excellent stability over time.

EXAMPLE 2

As in Example 1, 10 grams of potassium iodate are dissolved in 100 grams of the previous cationic resin. The clear solution does not manifest any instability phenomena or degradation with time.

EXAMPLE 3

A—Previously bleached cotton fabric is dyed with a sulfur dyestuff.

The following conditions are adopted:

3% of the Sulfur Blue 7 dyestuff of the Color Index,
3% sodium carbonate,
6% sodium sulfide,
10% sodium chloride.

The bath ratio is 1 to 10 and the dyeing is carried out for 60 minutes at a temperature of 98° C.

After dyeing, the sample is rinsed with cold water and is treated for 5 minutes at 60° C. in a bath containing 5 grams per liter of the formulation of Example 1.

The sample is then rinsed in cold water and dried.

B—An identical test is carried out in parallel.

After dyeing, the sample is rinsed and treated for 5 minutes at 60° C. in a solution 2 cc per liter of water oxygenated to 35%.

After treatment the color intensity and hue are identical for the two samples.

The determination of the stability under moist conditions for each sample shows the following results:

Sample treated in A oxidizing wash 4–5
alkali scour 5
washing at 98° C. 5

Sample treated in B oxidizing wash 3
alkali scour 3
washing at 95° C. 3–4.

EXAMPLE 4

The conditions of Example 3 are repeated utilizing the following dyestuffs:

Sulfur Brown 16
Sulfur Green 3
Sulfur Green 9.

After treatment, results comparable to the preceding Example are obtained, namely, in A an excellent resistance to various moist conditions and in B a comparatively considerable reduction of the same stability.

EXAMPLE 5

Dyeing is carried out according to the conditions of Example 1.

After dyeing and rinsing, the treatment is carried out with the formulation of Example 2 in a bath containing 8 grams per liter thereof.

As in the previous Examples, a comparative oxidation test with oxygenated water was carried out.

The following was observed:

in the course of oxidation, an oxidation velocity of the dyestuff which was very fast and practically identical in the two tests.

after treatment a level of stability under moist conditions which is much higher for the sample treated according to the conditions claimed by the invention and a stability very clearly much less for the sample oxidized with oxygenated water.

EXAMPLE 6

Example 3 is repeated. After dyeing the oxidation is carried out under the same conditions of time and temperature and utilizing the oxidizing compound according to the formulation of Example 1 but with 0.5 grams of potassium bromate.

After treatment one observes a normal hue of the color but a response to the different moist stability tests comparable to that which is recorded with the oxygenated water.

EXAMPLE 7

A cotton fabric is dyed according to the Pad Steam process utilizing the following conditions:

The fabric is impregnated in a bath having the following composition:

30 grams of Sulfur Blue 7
30 grams of sodium carbonate
50 grams of sodium sulfide.

After expressing the sample between rollers of a pad dyer so that 80% of the impregnated bath is retained, the sample is exposed to steam for 10 minutes at 100° C. in saturated vapor.

The sample is rinsed with cold water and then treated for 1 minute at 70° C. in a bath containing 20 grams per liter of the composition prepared in Example 1. After dyeing, a blue hue in total conformance to the reference type and possessing a high level of stability to the various moisture tests is obtained.

The present invention has, with respect to prior art techniques, the following advantages:

improvement of the response to moisture tests of the dyed products produced,
simplification of the application conditions,
more precise dosing of the additives introduced,
less risk of error because the manipulation is less important, and
reduction of the stocks of products which are necessary.

I claim:

1. A process for the simultaneous oxidation and fixation of dye on cellulosic fibers with sulfur dyestuffs, effected in the presence of a stable aqueous formulation simultaneously containing an oxidation agent selected from the group consisting of iodates and bromates of alkali metals and a fixation agent which is a thermohardenable cationic resin selected from the group consisting of reaction products of a polyester resin having a carboxylic group at the end of a chain with an epoxyamine addition compound the reaction being followed by a condensation with epichlorohydrin;

polyester-polyamide copolymers soluble in water and obtained by reacting a saturated or unsaturated aliphatic dicarboxylic acid containing 3 to 10 carbon atoms with a mixture of polyalkylenic polyamine and dialkanolamine in molar proportions of the dicarboxylic acid/polyamine/ and dialkanolamine of the order of 0.8 to 1.1/0.3 to 0.9/0.1 to 0.7, at a pH between 1 and 3 and a temperature between 120° and 200° C., the reaction of said copolymer with epichlorohydrin being effected between 45° and 100° C. at a ratio of 0.5 to 1.8 moles of epichlorohydrin per atom of active hydrogen; and reaction products of a polyamide derived from a polyalkylenic polyamide and a saturated, aliphatic, dicarboxylic acid containing 3 to 10 carbon atoms, with epichlorohydrin alone or conjointly with a quaternization agent.

2. The process defined in claim 1 wherein the relative proportions of the oxidation agent and the thermohardenable resin is between 0.1 and 10%.

3. The process defined in claim 1 wherein the quantity of the aqueous formulation which is used is between 1 and 30 g/l.

4. The process defined in claim 1 carried out on dyestuffs, supplied according to classical dyeing techniques by semi-continuous exhaustion or continuously.

5. Fibrous material obtained by carrying out the process defined in claim 1.

* * * * *